US007434435B2

(12) United States Patent
Richter et al.

(10) Patent No.: US 7,434,435 B2
(45) Date of Patent: Oct. 14, 2008

(54) METHOD AND DEVICE FOR APPLYING AN ADJUSTABLE TENSILE-STRESS DISTRIBUTION, IN PARTICULAR IN THE EDGE REGIONS OF COLD-ROLLED METAL STRIPS

(75) Inventors: Hans-Peter Richter, Friedewald (DE); Hartmut Pawelski, Ratingen (DE); Ludwig Weingarten, Düsseldorf (DE); Thorsten Bode, Düsseldorf (DE); Jürgen Klöckner, Netphen (DE); Ralf Ohrndorf, Hilchenbach (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/570,413

(22) PCT Filed: Aug. 27, 2004

(86) PCT No.: PCT/EP2004/009578

§ 371 (c)(1),
(2), (4) Date: Nov. 16, 2006

(87) PCT Pub. No.: WO2005/023444

PCT Pub. Date: Mar. 17, 2005

(65) Prior Publication Data

US 2007/0186609 A1 Aug. 16, 2007

(30) Foreign Application Priority Data

Sep. 4, 2003 (DE) ..... 103 40 694
Nov. 11, 2003 (DE) ..... 103 52 546

(51) Int. Cl.
*B21B 27/06* (2006.01)

(52) U.S. Cl. ..... 72/236; 72/43; 72/201; 72/252.5

(58) Field of Classification Search ..... 72/41, 72/42, 43, 44, 200, 201, 202, 236, 252.5
See application file for complete search history.

(56) References Cited

U.S. PATENT DOCUMENTS 3,802,237 A * 4/1974 Albensi et al. ..... 72/8.7

(Continued)

FOREIGN PATENT DOCUMENTS

DE 32 35 444 3/1984

(Continued)

OTHER PUBLICATIONS

Patent Abstracts of Japan, BD. 011, No. 368 (M-647), Dec. 2, 1987 & JP 62 142011 A (Ishikawajima Harima Heavy Ind Co Ltd), Jun. 25, 1987.

(Continued)

*Primary Examiner*—Edward Tolan
(74) *Attorney, Agent, or Firm*—Friedrich Kueffner

(57) ABSTRACT

The invention relates to a method and a device for applying an adjustable tensile-stress distribution, in particular in the edge regions during the cold-rolling of metal strips (16), in particular metal foil, in order to reduce the risk of an excessive build-up of tension and cracks at the edges of the strip, which can lead as a negative consequence to cracks in the strip and to a reduction in production, and in order to improve the surface of the strip and its planarity, even for a relatively high strip displacement speed, and also to reduce strip trimming widths. To achieve these aims, at least one or a combination of two of the following measures are implemented: a) separation of lubrication and cooling of the working rolls by lubricating on the run-in side and cooling on the discharge side, b) additional influencing of the strip edges using a hot edge spray", in particular by spraying (21) rolling oil with differing temperatures in zones, c) use of a special cross-sectional configuration of the working rolls (12, 12') in the vicinity of the strip edges, which creates a partial material build-up during the blooming pass, said build-up forming a longer strip edge with subsequent passes, thus counteracting the risk of an excessive build-up of tensile stress.

8 Claims, 4 Drawing Sheets

U.S. PATENT DOCUMENTS

| | | | | |
|---|---|---|---|---|
| 4,344,308 | A | 8/1982 | Shimada et al. | |
| 4,619,126 | A * | 10/1986 | Kolecki | 72/38 |
| 4,671,091 | A * | 6/1987 | Atack et al. | 72/45 |
| 4,706,480 | A * | 11/1987 | Svatos | 72/11.4 |
| 5,165,266 | A | 11/1992 | Ginzburg | |
| 5,212,975 | A * | 5/1993 | Ginzburg | 72/43 |
| 5,799,523 | A * | 9/1998 | Seidel et al. | 72/9.3 |
| 5,943,896 | A | 8/1999 | Rosenthal et al. | |
| 6,490,903 | B2 * | 12/2002 | Ravenet et al. | 72/236 |
| 6,497,127 | B2 * | 12/2002 | Nishiura et al. | 72/44 |
| 6,598,448 | B1 * | 7/2003 | Barten et al. | 72/201 |

FOREIGN PATENT DOCUMENTS

| | | |
|---|---|---|
| DE | 36 14 487 | 11/1987 |
| DE | 201 06 972 | 8/2001 |
| EP | 0 672 471 | 12/1999 |
| EP | 1 222 973 | 7/2002 |

OTHER PUBLICATIONS

Patent Abstracts of Japan, BD. 016, No. 137 (M-1231), Apr. 7, 1992 & JP 03 297507 A (Showa Alum Corp), Dec. 27, 1991.

Patent Abstracts of Japan, BD. 017, No. 350 (M-1438), Jul. 2, 1993 & JP 05 050122 A (Ishikawajima Harima Heavy Ind Co Ltd), Mar. 2, 1993.

* cited by examiner

Special cross section to build up material on the strip edge

METHOD AND DEVICE FOR APPLYING AN ADJUSTABLE TENSILE-STRESS DISTRIBUTION, IN PARTICULAR IN THE EDGE REGIONS OF COLD-ROLLED METAL STRIPS

The invention concerns a method for applying an adjustable tensile stress distribution, especially in the edge regions of the strip during the cold rolling of metal strip, for the purpose of reducing the risk of excessive buildup of tensile stress and the risk of edge cracks in the strip, which can have the negative consequence of strip breakage and thus reduced production, and for the purpose of improving the strip surface and its flatness, even at relatively high strip running speeds, and of reducing strip trimming widths. The invention also concerns a device for carrying out this method.

The document EP 0 054 172 A2 discloses a method in which, to achieve stress-free rolling of cold-rolled strip, the coefficient of friction between the strip surfaces and the roll barrel surfaces is influenced by the application of rolling lubricants. These lubricants are supplied as a function of partial tensile stresses determined after the last stand in zones lying in the transverse direction of the strip. In this regard, before the strip enters the roll gap, base oil of the rolling lubricant is applied directly to the strip surfaces in amounts determined by the determined partial tensile stresses and in locally limited regions. The goal of this measure is to apply the lubricant components locally to strips of the metal strip that is to be rolled, so that the locally improved lubrication reduces the rolling force there and thus also reduces the local flattening of the roll. In addition, the frictional heat introduced into the roll is reduced in these places.

The document EP 0 367 967 B1 discloses a method and a device in which the concentration of an emulsion of rolling oil is systematically influenced, and the emulsion or dispersion is caught and separated again after exiting the roll gap or running off before the roll gap. This makes it possible to prepare the emulsion or dispersion that is introduced into the roll gap repeatedly and in a timely way with a certain concentration before it is fed into the roll gap. The focus of this invention is the current and active preparation of the emulsion and the separation of the various media.

The document EP 1 188 494 A1 describes a strip wiping device, strip wiping method, rolling stand, and rolling method. To improve the productivity of a cold-rolling installation, the installation was equipped with a strip wiper.

At high-speed rolling of more than 700 m/min, which could not be realized with conventional wiper rolls or tube wipers, the productivity of the cold-rolling installation and the surface quality of the strip were significantly improved by adding the wiping device.

The document EP 0 672 471 B1 discloses a method and a device for rolling strip, in which wear-resistant rolls with increased radii of at least one of their end regions are used. The rolls are axially displaced relative to each other in such a way that the rolled strip is in contact over its width with the regions of the rolls that have the smaller radii. With increasing heating of the rolls and with thermal cambering of the rolls, the rolls are displaced in opposite directions relative to each other until areas of their greater radius are moved over edge regions of the rolled strip. This eliminates the cambering of the strip that would otherwise occur due to the increasing thermal cambering.

The document DE 199 08 743 A1 discloses a method and a device for drying and keeping dry especially cold-rolled strip in the runout area of cold-rolling mills and strip mills. To dry and keep dry especially rolled strip, it is known that a partition can be used to separate the dry area of the finish-rolled strip from the damp area of the rolling stand. For this purpose, the invention proposes contact-free sealing between the partition and the strip by a cushion of compressed gas similar to an air cushion, and a split flow, so that compressed gas from blast nozzle bars with large numbers of blast nozzles is applied to the surface of the strip at right angles from above and below. Even at high strip speeds above 1,000 m/min, this measure successfully prevents the penetration of rolling oil or even emulsion, regardless of the strip width, and allows contact-free strip drying.

The document DE 101 31 369 A1 discloses a method and a device for cooling and/or lubricating rolls, especially the work rolls of a rolling stand, and a rolled strip conveyed through and rolled between these rolls with the use of water in the form of spray jets as the cooling medium and spray oil, oil/air mixture, or oil/water mixture as the lubricant. In order to improve the lubricating and cooling effects, the combined use of supercooling the strip surface and roll surface and roll lubrication on the input side of the stand is disclosed, in which both media, i.e., water and lubricant, are separately fed to the rolls and the rolled strip and applied to the roll surface at different application points. Separate reservoirs for water and lubricant and separate supply lines to the spray bars for water and to the spray bars for the lubricant are provided. This provides the great advantage of optimum use of both the lubricating and cooling effect of the two media, water and lubricant, and thus, at the same time, reduction of the energy and power consumption due to the minimization of the coefficients of friction on the rolls. The ground surface of the roll withstands even the highest loads. The previously observed material scaling of the rolls is prevented. The surface of the rolling stock remains optimally smooth. Scale inclusions and chatter marks on the strip surface are eliminated.

Proceeding from the cited prior art, the objective of the invention in the cold-rolling sector, especially in the aluminum industry, but in certain cases in the steel industry and the nonferrous metal industry as well, is to minimize stiff strip edges and long strip fibers near the edge that develop during thin rolling, to reduce strip breakage, to save trimming, and thus to improve the quality and quantity of production.

In accordance with the invention, these objectives with respect to a method of the type specified in the introductory clause of claim 1 are achieved by the method specified in the characterizing clause of claim 1.

The measures of the invention demonstrably produce a significant reduction of the risk of strip breakage and also improve the strip surface.

Adjustable tensile stress distribution, especially in the edge region of the strip, results in a higher material throughput with a reduction of nonproductive time and an increase in operating speed. In addition, there is an overall significant improvement in flatness, production is increased, and the amount of circulating rolling oil is reduced.

In a modification of the method of claim 1, a greater diameter reduction of the work rolls is undertaken in the edge region due to a partial diameter increase during their shaping by inductive heating.

In addition, use can be made of a measure by which the strip tensile stress distribution is varied by a concavely bendable or bent deflecting roll in such a way that the strip tensile stress is reduced at the edges of the strip and increased in the center of the strip.

Finally, use can be made of the additional measure that in roughing passes material is built up at the edges of the strip by edge sprays with lubricants of relatively high viscosity.

In addition, the aforementioned objective is achieved by a device for developing a controllable tensile stress distribution. The advantages associated with this device have already been described in connection with the method of the invention.

An advantageous modification of the device of the invention has a deflecting roll that is convexly bendable or bent in the strip running direction and is arranged between two guide rolls to change the tensile stress distribution of a strip before it enters a rolling stand.

To supplement this feature, the device is also designed in such a way that, on the run-in side of a rolling stand, it has means for the direct application of additive, e.g., for lubricating oil of relatively high viscosity, especially to the rolled strip, and on the runout side of the work rolls, it has means for cooling the barrels of the work rolls and preferably additional means for removal of the lubricant, which means advantageously spray the rolled strip both from above the strip and from below the strip with the associated spray media.

Finally, the device of the invention has a device that removes coolant on the runout side of the stand.

Further details, features, and advantages of the invention are explained below with reference to the specific embodiment of the invention that is illustrated in the drawings.

Figure 1:
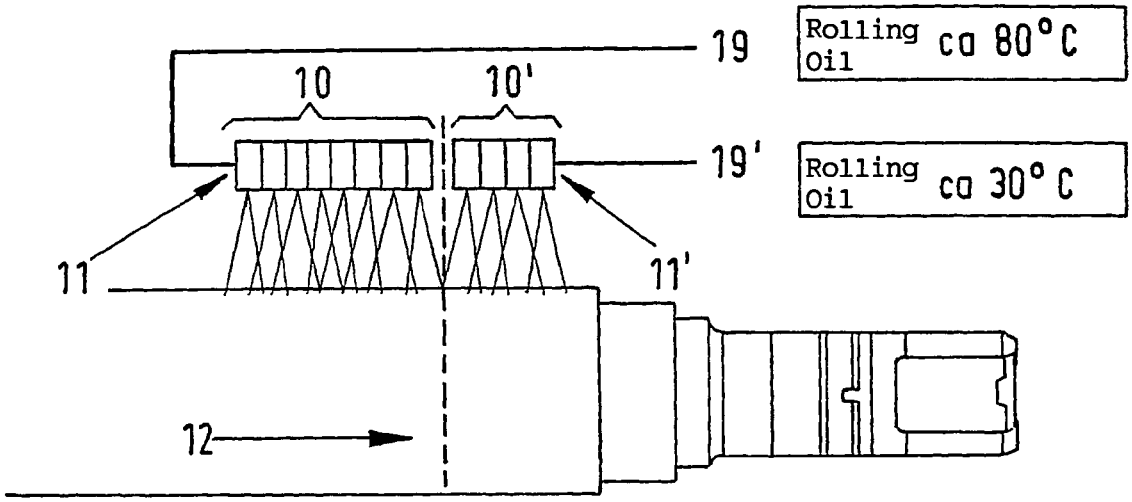
FIG. 1 shows a device for hot edge spray at the roll edge.

FIG. 1 shows part of a device for applying an adjustable tensile stress distribution, especially in the edge regions during the cold rolling of metal strip, with spray nozzle systems 11, 11' arranged in at least two separate zones 10, 10' with connections to separate spray medium supply lines 19, 19'to different zones 10, 10' of each work roll 12. In addition, there is the possibility of partial inductive heating of the work roll in a way that is already well known.

Figure 2:
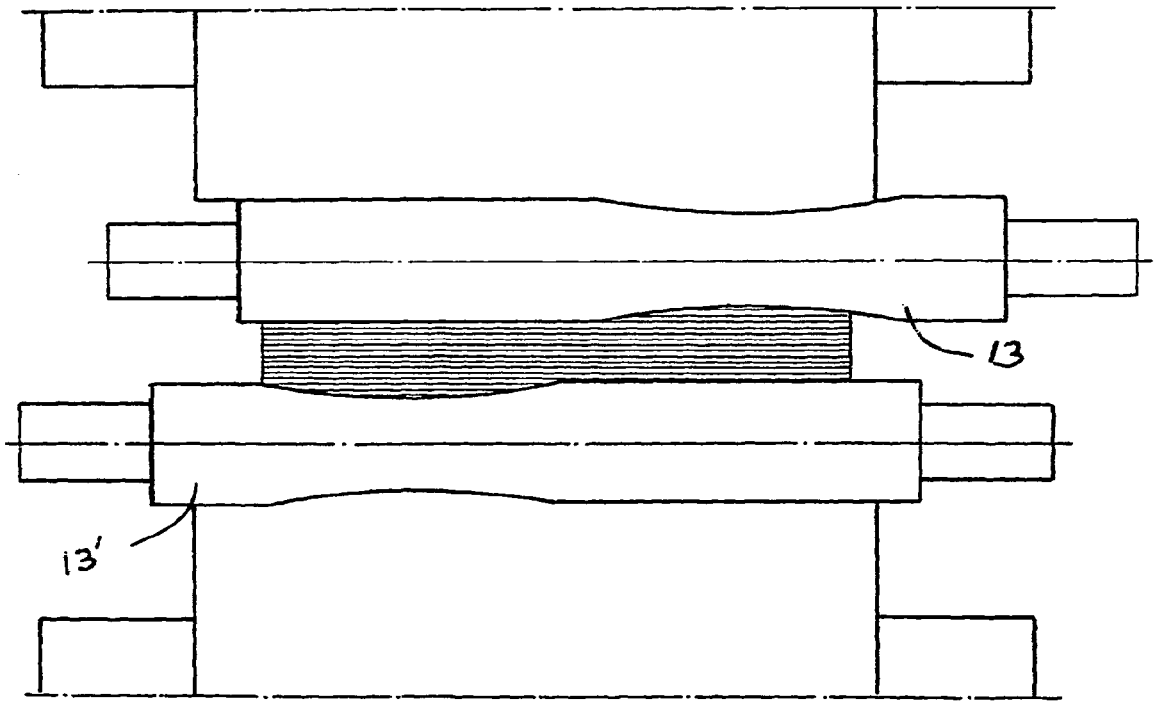
FIG. 2 shows a special cross section for work rolls.

FIG. 2 shows a pair of work rolls 12, 12', each of which has a special cross section 13, 13' in one end region with increased diameters in the end regions to lengthen the strip edges to be rolled with simultaneous reduction of tensile stresses and reduction of long strip fibers.

Figure 3:
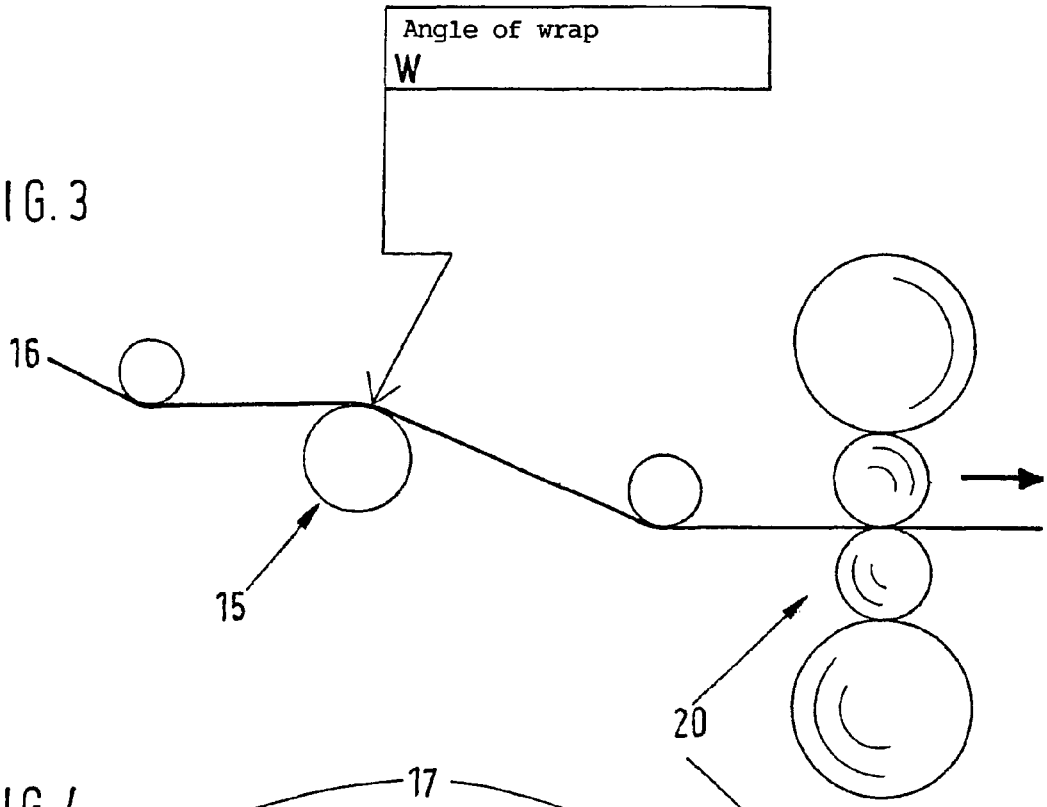
FIG. 3 shows a convexly bendable or bent deflecting roll in a side view.
Figure 4:
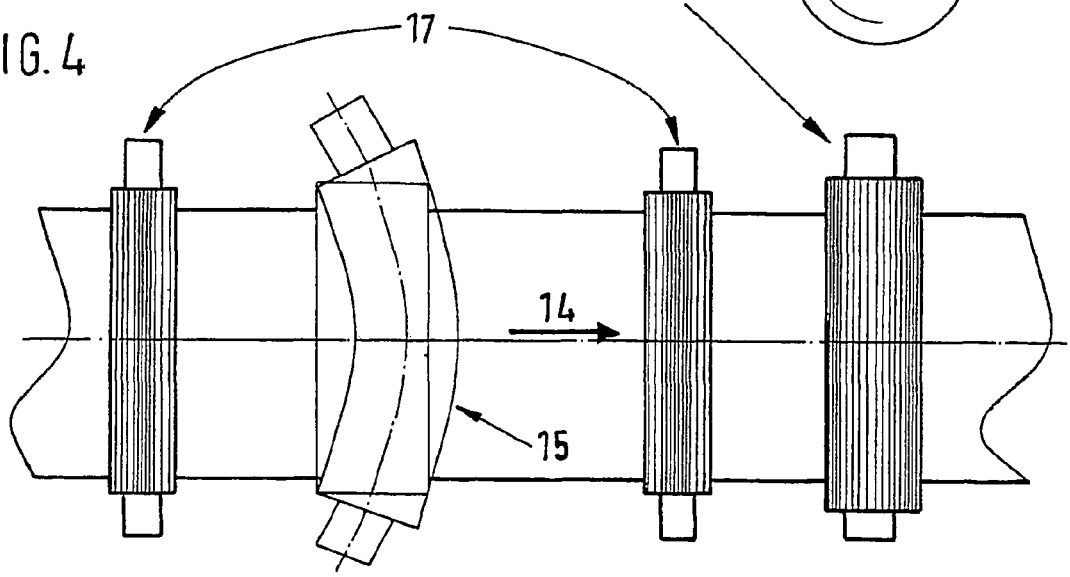
FIG. 4 shows the top view of the deflecting roll of FIG. 3.

FIGS. 3 and 4 show a side view and a top view, respectively, of a system for lengthening the tensile stress distribution by means of the strip width in shaping passes. This is accomplished by a variable angle of wrap W for different strip thicknesses:

| | |
|---|---|
| 1-6 μm | with W = 60-90° |
| 8-20 μm | with W = 45-60° |
| >20 μm | with W = 45° and higher |
| for metal foils | with W = 15-20° |

Figure 5:
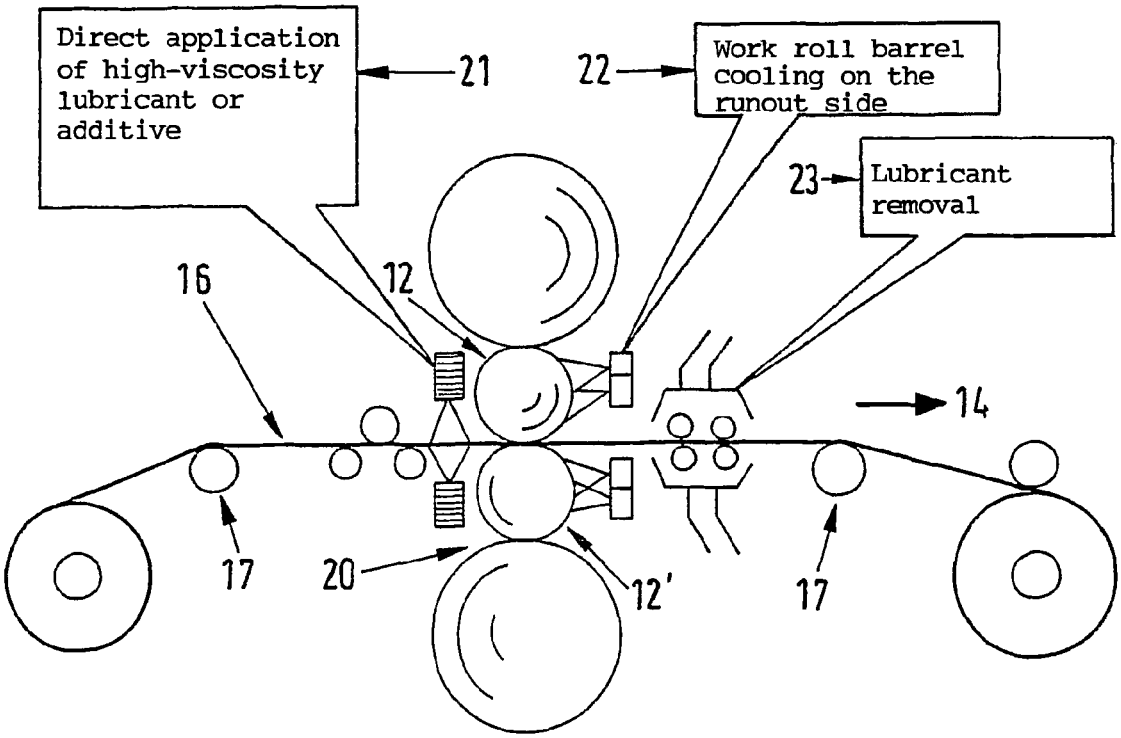
FIG. 5 shows a side view of an installation of the invention with direct application of lubricant to the rolled strip, roll cooling on the runout side, and lubricant removal.

FIG. 5 shows a side view of an installation of the invention, with an uncoiler on the left side and a coiler on the right side, guide devices for the rolled strip 16 in the strip running direction 14, means 21 for the direct application of high-viscosity lubricant or additive on the strip run-in side, means 22 for cooling the barrels of the work rolls on the runout side, and means 23 for the removal of lubricant on the runout side. A buildup of material on the strip edge during the roughing passes and thus a buildup of material on the strip edge during the shaping passes are achieved with the aid of direct application of additive on the run-in side and roll cooling on the runout side.

LIST OF REFERENCE NUMBERS

10, 10' spray zone
11, 11' spray nozzle system
12, 12' work rolls
14 strip running direction
15 deflecting roll
16 strip
17 guide roll
19, 19' spray medium supply lines
20 rolling stand
21 additive application
22 roll barrel coolant
23 lubricant removal

The invention claimed is:

1. Method for applying an adjustable tensile stress distribution in edge regions during the cold rolling of metal strip, for the purpose of reducing a risk of excessive buildup of tensile stress and a risk of edge cracks in the strip, which can have a negative consequence of strip breakage and thus reduced production, and for the purpose of improving the strip surface and its flatness, even at relatively high strip running speeds, and of reducing strip trimming widths, comprising the step of:

(a) separation of lubrication and cooling of work rolls by lubrication on a run-in side and cooling on a runout side, the improvement comprising the additional steps of:

(b) additional influencing of the strip edges by hot edge spray by spraying rolling oil with different temperature ranges in different zones, (c) the use of work rolls having a special cross-sectional configuration in an area of the strip edges, which special configuration is independent of the hot edge spray, for partial material buildup during a roughing pass, which results in a longer strip edge in following passes and counteracts the risk of excessive buildup of tensile stress.

2. Method in accordance with claim 1, wherein a greater diameter reduction of the work rolls is undertaken in the edge region due to partial diameter increase during shaping by inductive heating.

3. Method in accordance with claim 1, wherein the strip tensile stress distribution is varied by a concavely bendable or bent deflecting roll in such a way that the strip tensile stress is reduced at the edges of the strip and increased in the center of the strip.

4. Method in accordance with claim 1, wherein in roughing passes, material is built up at the edges of the strip by edge sprays with lubricants of relatively high viscosity.

5. Device for developing an adjustable tensile stress distribution in edge regions during the cold rolling of metal strip, the device comprising at least one spray nozzle system (11, 11') on a run-in side for applying lubricant and means for cooling the barrels of the work rolls on a runout side; wherein at least two of the spray nozzle systems (11, 11') have connections for separate spray medium supply lines (19, 19') for spraying the lubricant in the form of rolling oil with different temperatures in different zones (10, 10') of each work roll (12); and that each of the work rolls (12, 12') has a special cross section (13, 13') with increased diameters in the end regions of the work rolls (12, 12') for the purpose of lengthening the rolled strip edges with simultaneous reduction of tensile stresses and reduction of long strip fibers in regions near the edges of the strip.

6. Device in accordance with claim 5, comprising a deflecting roll (15) that is convexly bendable or bent in the strip running direction (14) and is arranged between guide rolls (17) to change the tensile stress distribution of a strip (16) before it enters a rolling stand (20).

7. Device in accordance with claim 5, wherein on the run-in side of a rolling stand (20), it has means (21) for the direct application of additive to the rolled strip (16), and on the runout side of the work rolls (12, 12'), it has means (22) for cooling the barrels of the work rolls and preferably additional means (23, 23') for removal of the lubricant, which advantageously spray the rolled strip (16) both from above the strip and from below the strip with the associated spray media.

8. Device in accordance with claim 5, wherein it has a device that removes coolant on the runout side of the stand (20).

* * * * *